US009395140B2

(12) United States Patent
Ell

(10) Patent No.: US 9,395,140 B2
(45) Date of Patent: Jul. 19, 2016

(54) OFFSET RISER STRUCTURE FOR ARCHERY BOWS

(71) Applicant: Hoyt Archery, Inc., Salt Lake City, UT (US)

(72) Inventor: Jeremy Ell, Stansbury Park, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 0 days.

(21) Appl. No.: 14/512,886

(22) Filed: Oct. 13, 2014

(65) Prior Publication Data

US 2016/0102937 A1 Apr. 14, 2016

(51) Int. Cl.
*F41B 5/00* (2006.01)
*F41B 5/14* (2006.01)
*F41B 5/10* (2006.01)

(52) U.S. Cl.
CPC ..... *F41B 5/0031* (2013.01); *F41B 5/1403* (2013.01); *F41B 5/10* (2013.01)

(58) Field of Classification Search
CPC ..... F41B 5/10; F41B 5/0031; F41B 5/1403
USPC ..... 124/23.1, 25.6, 86, 88
See application file for complete search history.

(56) References Cited

U.S. PATENT DOCUMENTS 2,736,309 A * 2/1956 Hoffman ..... F41B 5/0073 124/23.1
3,055,353 A * 9/1962 Perrucci ..... F41B 5/0005 124/24.1
D227,098 S * 6/1973 Wilson et al. ..... F41B 5/0031 D22/107
5,099,819 A * 3/1992 Simonds ..... F41B 5/10 124/23.1
5,682,871 A * 11/1997 Walk ..... F41B 5/10 124/24.1
6,758,204 B1 * 7/2004 Goff ..... F41B 5/10 124/25.6
7,066,165 B2 * 6/2006 Perry ..... F41B 5/0005 124/23.1
7,373,934 B2 * 5/2008 Smith ..... F41B 5/10 124/25.6
8,079,353 B2 * 12/2011 Davis ..... F41B 5/0026 124/23.1
8,807,125 B1 * 8/2014 Mathur ..... B29C 45/0005 124/23.1
2007/0084451 A1 * 4/2007 Perry ..... F41B 5/14 124/23.1
2007/0101980 A1 * 5/2007 Sims ..... F41B 5/10 124/25.6
2007/0193567 A1 * 8/2007 D'Acquisto ..... F41B 5/0026 124/23.1
2014/0261354 A1 * 9/2014 Ross, Jr. ..... F41B 5/143 124/23.1
2014/0360478 A1 * 12/2014 Ady ..... F41B 5/1403 124/23.1
2015/0083098 A1 * 3/2015 Derus ..... F41B 5/0031 124/23.1

(Continued)

OTHER PUBLICATIONS

UltraElite Riser Structure, Product Guide 2004, Hoyt USA, 2004.

(Continued)

*Primary Examiner* — Alexander Niconovich
(74) *Attorney, Agent, or Firm* — Holland & Hart

(57) ABSTRACT

An offset riser for an archery bow has an upper end and a lower end each having limb attachment points, wherein a central plane laterally divides the bow through the upper and lower limb attachment points. The riser has a handle portion positioned between the upper end and the lower end and a front strut extending from the upper end to the handle portion, wherein the front strut has a front sight window portion that is offset from the central plane. A rear strut extends from the upper end to the handle portion as well, and it has a rear sight window portion that is offset from the central plane. In this riser, the front sight window portion has a different vertical location of transition lateral to the central plane than the rear sight window portion. This may produce increased stiffness, better visibility, less vibration, and other desirable characteristics.

16 Claims, 8 Drawing Sheets

(56) References Cited

U.S. PATENT DOCUMENTS

| | | | | |
|---|---|---|---|---|
| 2015/0153131 | A1* | 6/2015 | Trpkovski | F41B 5/1426 124/25.6 |
| 2016/0025443 | A1* | 1/2016 | Valsecchi | F41B 5/0026 124/23.1 |

OTHER PUBLICATIONS

Elite Energy 32 Riser Structure, Product Guide, Elite, 2015, p. 8.
Alien Nitro Riser Structure, Product Guide, Martin Archery, 2014.
Carbon Matrix Riser Structure, Product Guide, Hoyt Archery, 2010.

* cited by examiner

OFFSET RISER STRUCTURE FOR ARCHERY BOWS

TECHNICAL FIELD

The present disclosure relates generally to the field of riser structures for archery bows that have offset portions and relates specifically to risers that are offset at a sight window and have dissimilar sight window transitions back to neutral axes of the risers.

BACKGROUND

Skilled archers are constantly seeking bows that are lighter, stronger, steadier, and easier to use. To this end, bow manufacturers have produced a wide array of technological advancements to improve the archer's accuracy, precision, and target view during a shot. For example, as a result of a growing trend for overall mass reduction in bows, bow risers are made light and easy to carry by being formed with a thin skeletal structure and may have a sight window to assist the archer's aim.

The sight window of a typical riser is a portion of the riser that is laterally offset from a neutral axis that runs vertically through the connection points of the limbs to the riser. Risers with a sight window do not directly obstruct the archer's vision of the plane or area through which the arrow will be launched, so he or she may have a better view of the target. Bow sights may also be positioned in the sight window to assist the archer's aim.

Despite these advantages, implementing a sight window usually also has drawbacks for the archer, especially when the riser has the aforementioned thin structural members. At some point, weight of the riser can no longer be reduced without exceeding the material's yield stress capability and allowing unwanted bending of the riser. Because the sight window is offset from the neutral axis of the bow, tension applied to the riser while drawing the bow may twist or bend the riser at the sight window toward the neutral axis at transition portions of the riser where the riser is laterally offset. The tension and torque must be countered by the archer's grip to keep the bow in equilibrium, so when the bowstring is released, the bow may be torqued or jump in the archer's grip as the tension in the limbs is released. These reactive motions of the bow may reduce accuracy, increase vibration, and deflect arrow flight. There is therefore a need for improvements in bow risers that provide stiffness at the sight window while minimizing twisting and bending through the cycle of draw and release while still providing light and reliable riser structure.

SUMMARY

In one aspect of the present disclosure, an offset riser for an archery bow is provided which may comprise an upper end and a lower end, the upper end having an upper limb attachment point, the lower end having a lower limb attachment point, wherein a central plane laterally divides the bow through the upper and lower limb attachment points. The bow may also have a handle portion positioned between the upper end and the lower end and a front strut extending from the upper end to the handle portion, the front strut having a front sight window portion, the front sight window portion being offset from the central plane. A rear strut may extend from the upper end to the handle portion, with the rear strut having a rear sight window portion offset from the central plane. In this riser, the front sight window portion may have a different vertical location of transition than the rear sight window portion.

In some embodiments, the front sight window portion may have a greater vertical length of transition than the rear sight window portion. The front and rear struts may be tubular. The front and rear struts may also be connected by a web which, in some cases, may be non-tubular.

A distance between a top of a transition portion of the front sight window portion and a bottom of a transition portion of the rear sight window portion may be at least four inches, and a vertical distance between a center of the transition portion of the front sight window portion and a center of the transition portion of the rear sight window portion may be at least one half inch. A line between a midpoint of the transition portion of the front sight window portion and a midpoint of the transition portion of the rear sight window portion may not be parallel to the central plane. At the transition portions of the front and rear sight window portions, a combined lateral width of the front and rear sight window transition portions may be greater than a lateral width of either the front sight window transition portion or the rear sight window transition portion.

In another aspect, an archery bow may be provided with an offset riser, wherein the bow may comprise a riser having a lower end, an upper end, a sight window portion laterally offset from the upper and lower ends, and a window transition portion positioned between the sight window portion and the upper end. The window transition portion may have a front strut and a rear strut, the front strut having a first area centroid, the rear strut having a second area centroid. An upper limb may be attached to the upper end, a lower limb may be attached to the lower end, and a bowstring may be attached to the upper and lower limbs. In this bow, the first area centroid may have a different lateral position than the second area centroid.

At least one of the first and second area centroids may lie on a neutral axis of the riser. The first and second area centroids may also be positioned non-parallel to the neutral axis of the riser. The window transition portion may comprise a rib envelope, such as, for example, a web of structural support members extending between the front and rear struts. The window transition portion may have a height of at least four inches. A front portion of the window transition portion may transition to the upper end higher on the riser than a rear portion of the window transition portion. The front and rear struts may each be laterally narrower than an overall lateral width of the window transition portion.

In another aspect of the disclosure, a method of reducing twist and deflection of a bow riser may be set forth. The method may include providing a bow riser having a front strut and a rear strut, the front strut having a front offset transition portion and the rear strut having a rear offset transition portion, wherein the front and rear offset transition portions are vertically staggered along a longitudinal axis of the bow riser. The method may further include loading the bow riser to induce a front shear flow component and a rear shear flow component, wherein one of the front or rear shear flow components lies near or along a neutral axis of the bow riser while another of the front or rear shear flow components lies off the neutral axis. This method may be applied to offset sight window transition portions of the struts, and may also be applied to other portions of lateral offset struts of a riser.

In some embodiments of the method, the front and rear struts may be connected using a rib envelope. Loading the bow may comprise applying a rearward directed external force along the neutral axis. This may result in a rearward and inward force to the rear offset transition portion of the riser. Loading the bow may also comprise applying an outward force to the front strut and an inward force to the rear strut. The bow may be loaded by drawing a bowstring attached to limbs attached to the bow riser.

The above summary is not intended to describe each embodiment or every implementation of the present invention. The figures and the detailed description that follow more particularly exemplify preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
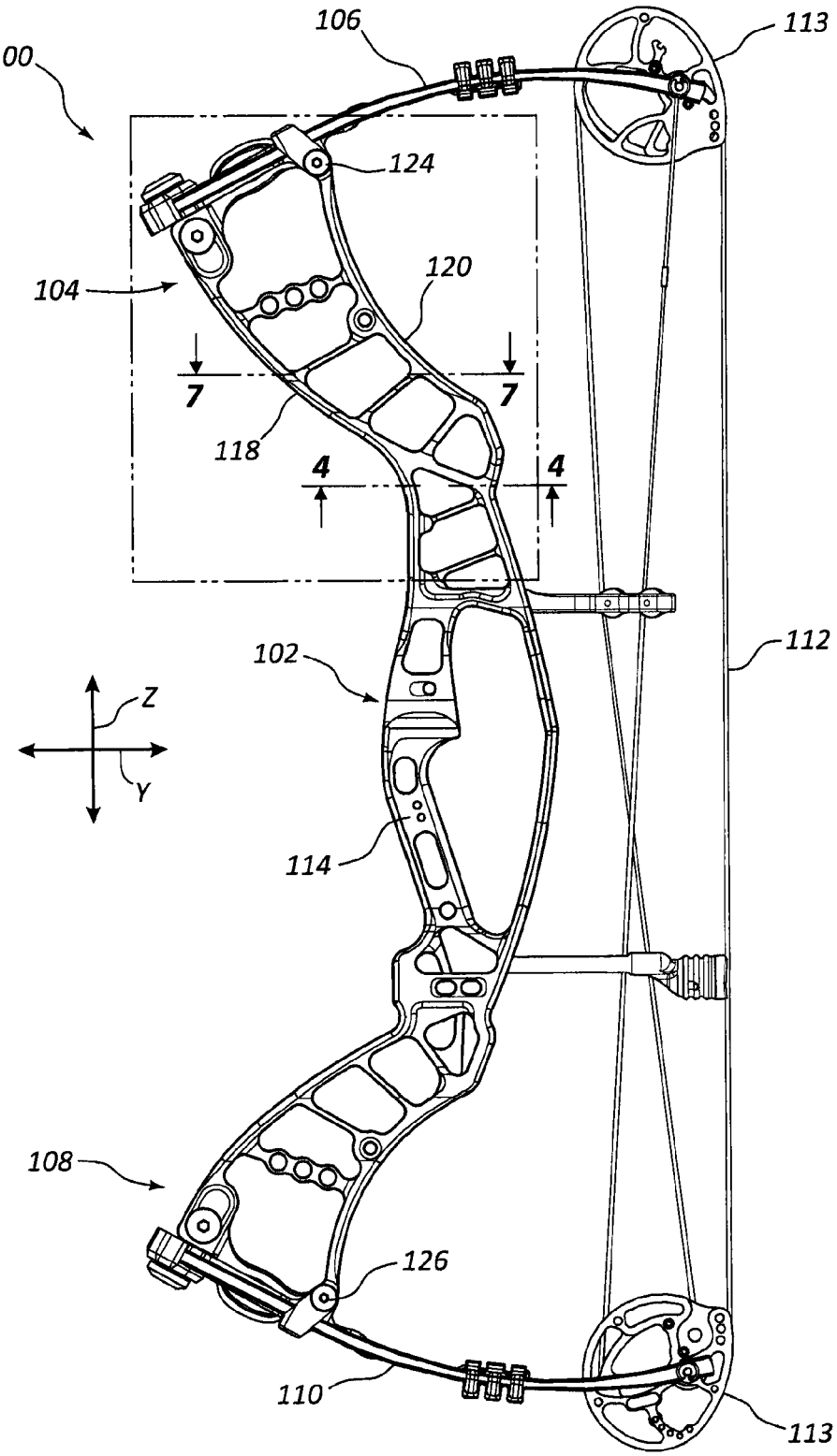
FIG. 1A is a side view of a bow according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to an offset riser for an archery bow that may provide improved stiffness and/or increased size to the sight window portion of the riser while also being light and durable. The riser may comprise a front strut and a rear strut at the upper end of the sight window portion of the riser. To form the top of the sight window, the front and rear struts may be shaped with a lateral offset or bend that transitions the strut structures between a central plane or neutral axis of the riser and a laterally offset position of the riser. This laterally offset portion is the sight window.

Embodiments of the present disclosure may be referred to as offset riser structures because the front and rear struts make this transition between the central plane and the offset portion at different vertically-offset positions. For example, the front strut may transition between being aligned with the central plane to being aligned with the laterally offset window portion of the riser at a higher vertical position than the rear strut. Alternatively, the front and rear struts may be defined as being vertically offset because area centroids of each of the struts may be laterally offset on a horizontal plane through the transition portions. Similarly, the front and rear struts may have shear flow components lying at different positions relative to a neutral axis of the riser.

Shear flow may be the shear force of the structure resisting external force per unit length. The total shear flow of any section may be equal to the value of the external shear at that section. The offset strut transitions may improve the shear flow through the upper portion of the riser so that there is less bending when the bow is loaded (e.g., drawn), thereby leading to less movement of the bow and/or arrow during the shot. Additionally, the decreased bending may allow the laterally offset section of the sight window to be further dramatically offset than existing risers while allowing at most the same amount of bending as existing risers, so an archer's visibility through the sight window may be improved. Also, because the overall structure is widened both in- and out-of-plane, less material is required to create the same stiffness.

Decreasing the twist and deflection of the riser using these techniques may result in a better vibration profile for the archer. The lower felt vibration and faster settling time creates a better overall feel and experience which may be unique to these embodiments. Further, because the riser is more resistant to twist and deflection, the axles of the bow also deflect less through the draw cycle. This improvement in out of plane axle movement allows for a straighter string path on release of the arrow, improving nock travel and tuning for the archer.

Spreading the transition across a wider sectional area of the riser may reduce deformation of the top of the riser under load. By placing the rear strut transition at the bottom of the overall sight window transition, further torsional stiffness is gained with the same amount of riser material that could be gained in conventional risers. Additionally, less material may be used to gain similar stiffness to conventional risers resulting in reduced overall mass. The offset transition structures may be formed by offsetting the struts and using a lofted surface to create the inside rib envelope between the front and rear struts. The front and back struts may also simply have two dissimilar transition portions.

The present disclosure may describe an external loading of an archery bow limited to the holding and drawing force, which is horizontal. Concepts of beam analysis may be used to describe the advantages of the present disclosure. Techniques herein may consider the internal shear reaction which is generally transverse to the beam structure. Most descriptions will be considered using beam analysis techniques which are common to those skilled in the art.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments. While the features and configurations described herein are generally directed to sight window transition portions of an offset riser for a bow, it will be understood by those having ordinary skill in the art that an offset strut transition configuration may be implemented in other parts of a riser besides the sight window transition.

Figure 1B:
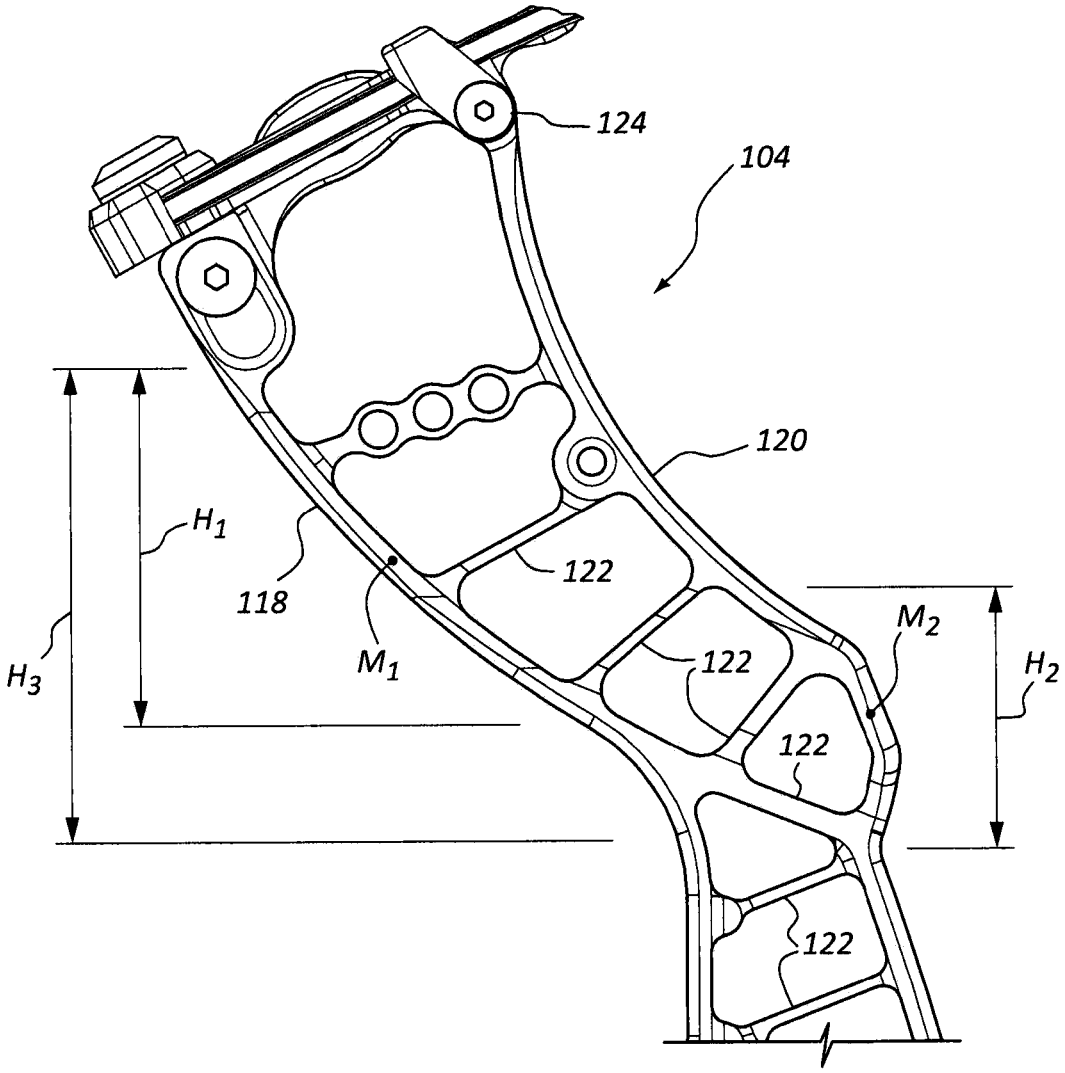
FIG. 1B is a detail view of the upper end of the bow of FIG. 1A.
Figure 2A:
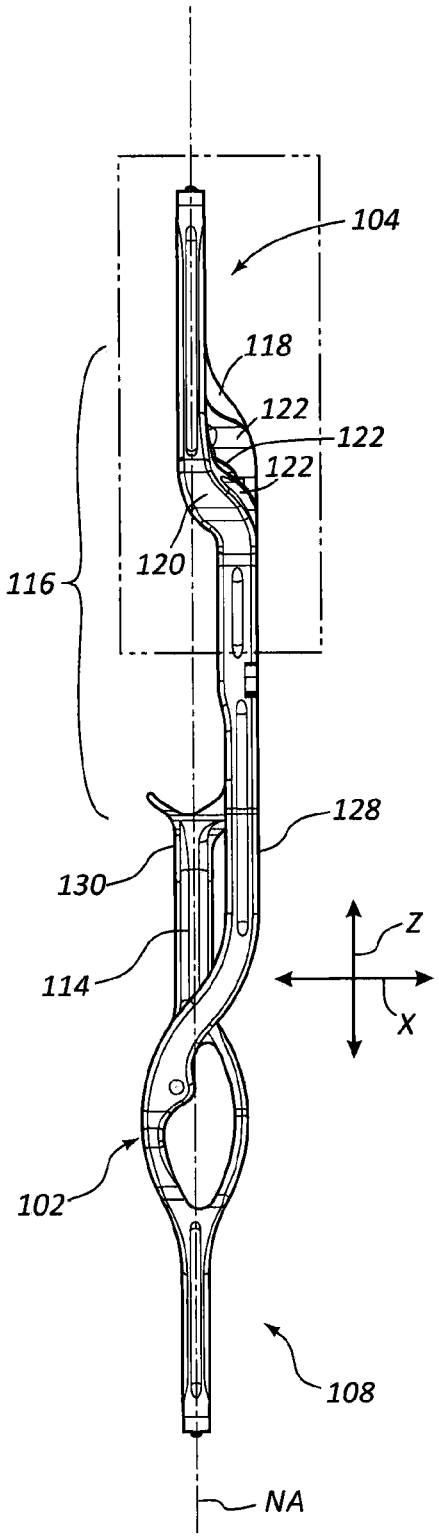
FIG. 2A is a rear view of the riser of the bow of FIG. 1A.
Figure 2B:
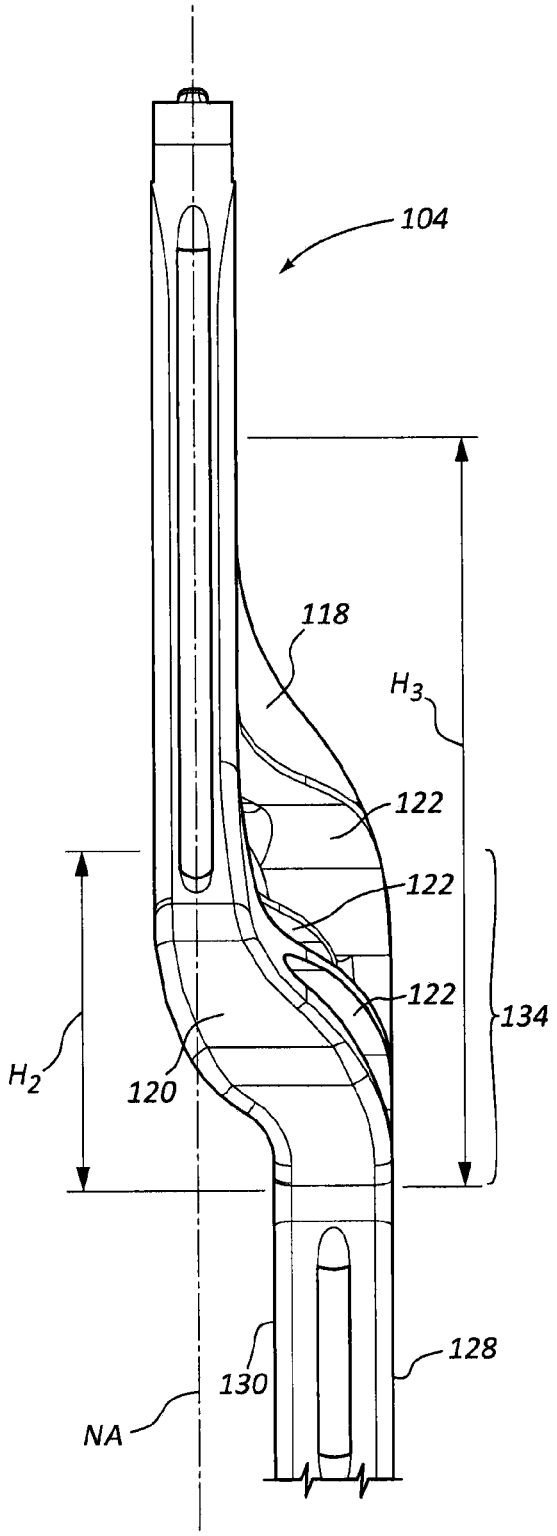
FIG. 2B is a detail view of the upper end of the riser of FIG. 2A.
Figure 3A:
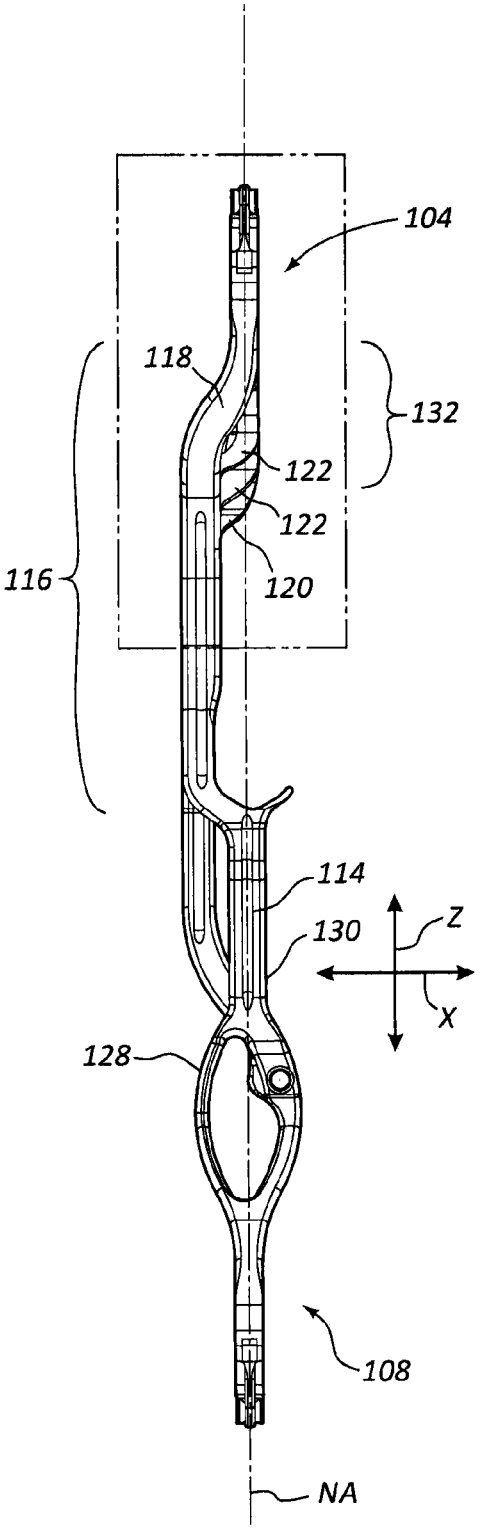
FIG. 3A is a front view of the riser of the bow of FIG. 1A.
Figure 3B:
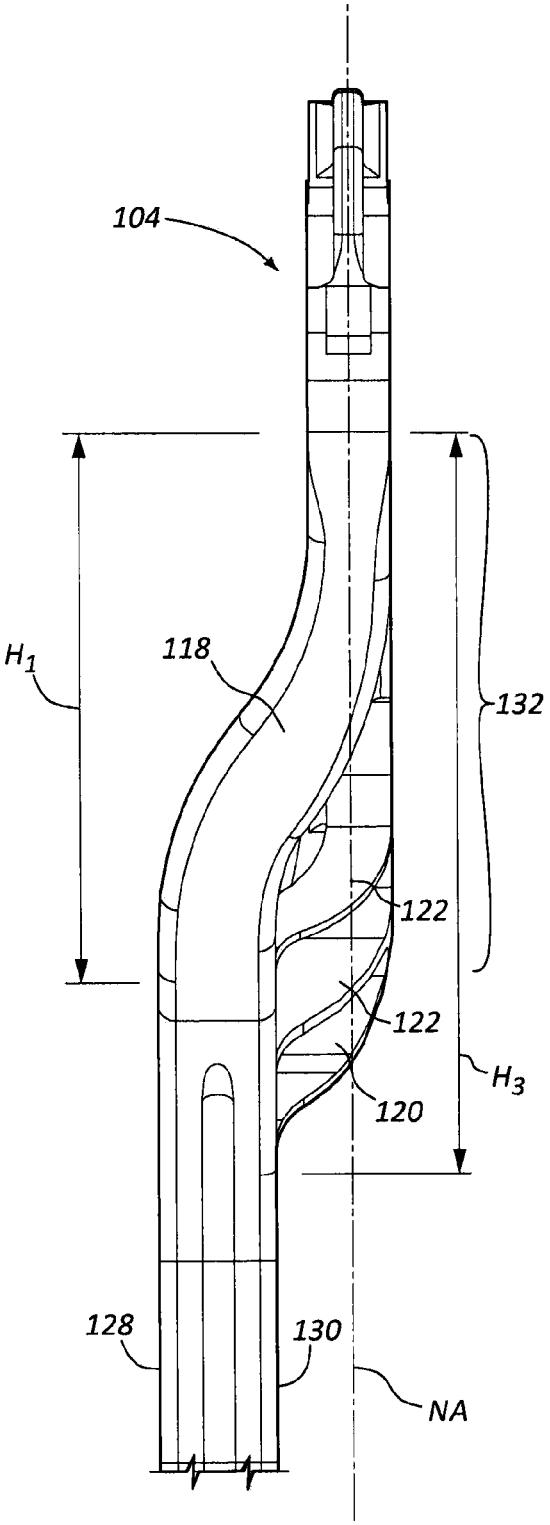
FIG. 3B is a detail view of the upper end of the riser of FIG. 3A.

Referring now to the figures in detail, FIG. 1A shows a side view of a bow 100 having a riser 102. The riser 102 may have an upper end 104 connected to upper limbs 106 and a lower end 108 connected to lower limbs 110. The limbs 106, 110 may be linked by a bowstring 112. In a compound bow (as shown), the limbs 106, 110 may also support cams 113 or rollers for the bowstring 112. Other accessories and attachments may also be linked to the bow 100. FIG. 2A shows a rear view of the riser 102, FIG. 3A shows a front view of the riser 102, and FIGS. 1B, 2B, and 3B show detail views of the upper end 104 of the riser 102 from side, rear, and front views, respectively.

The riser 102 may comprise a handle portion 114 between the upper end 104 and lower end 108. A sight window portion 116 may be positioned between the handle portion 114 and the upper end 104. The riser 102 may have a generally skeletal construction, wherein at least the sight window portion 116 may comprise at least a front strut 118 and a rear strut 120. See FIG. 1B. The front and rear struts 118, 120 may be linked by a web comprising multiple support structures 122 extending between the front and rear struts 118, 120. The support structures 122 may be collectively referred to as a rib envelope or a web that extends between the front and rear struts 118, 120. In some embodiments the rib envelope may be formed by a lofted surface or as a lofted web. The web may also have a constant cross-sectional shape.

Although in the figures only one kind of bow 100 is depicted, in various embodiments the bow 100 may be any kind of bow using a sight window, such as, for example, a traditional bow, a recurve bow, or a compound bow. Similarly, the bow 100 may be configured for sport archery, hunting, and/or other archery activities.

The riser 102 may be a separate component from the limbs 106, 110 of the bow 100 or may be integrated with the limbs 106, 110. The upper end 104 of the riser 102 and lower end 108 of the riser 102 may be identified when the riser 102 is held vertically, with the sight window portion 116 of the bow 100 being above the handle portion 114. Thus, the terms "upper" and "lower" as used herein are for convenience in referring to the figures and are not intended to restrict the orientation of the riser 102 to a predetermined position during usage or construction. Alternatively, the upper end 104 may be referred to as a first end of the riser 102 and the lower end 108 may be referred to as a second end of the riser 102.

The upper and lower ends 104, 108 of the riser 102 may have different shapes. For example, as shown in FIG. 2A, the lower end 108 of the riser 102 may comprise a shape that does not provide a sight window. Additionally, the handle portion 114 may not be centrally located between the upper and lower ends 104, 108 of the riser 102. In the embodiments shown, the grip of the handle portion 114 is closer to the lower end 108 of the riser 102 than to the upper end 104.

The upper limbs 106 and the lower limbs 110 may be flexible members configured to store and release energy when the bow 100 is drawn and released. The upper limbs 106 and the lower limbs 110 may be attached to the upper and lower ends 104, 108 of the riser 102. In some embodiments the limbs 106, 110 may be connected by limb bolts or other fasteners. Upon connection, the limbs 106, 110 may apply forces to the riser 102 when the bowstring 112 is drawn. See also FIGS. 5A-5C. Loading of a riser may occur in the brace condition when limbs and strings are connected to the riser. The loading may increase as the bow is drawn.

The sight window portion 116 may be defined as the portion of the bow 100 along which at least one of the front and rear struts 118, 120 is laterally offset from a neutral axis or central plane of the riser 102. The sight window portion 116 may be a cutout or curved portion of the riser 102. The sight window portion 116 shown is for a right-handed bow, as shown by the handle portion 114 being configured to be held by a left hand. In other embodiments, the riser 102 may be configured to be held by a right hand, such as, for example, for a left-handed bow.

The front strut 118 and rear strut 120 may be defined as portions of the riser 102 that run along and form the front and rear of the riser 102, respectively. As shown in FIG. 1A, the front and rear struts 118, 120 curve forward above and below the handle portion 114 to the attachment points of the limbs 106, 110. As shown in FIGS. 2A and 3A, the front and rear struts 118, 120 curve laterally between the attachment point of the upper limbs 106 and the handle portion 114. The front strut 118 curves back toward the handle portion 114 at the top of the handle portion 114 (see FIG. 3A), and rear strut 120 curves back toward the handle portion 114 below the handle portion 114 (see FIG. 2A). This may allow the handle portion 114 to be gripped without the archer's wrist or forearm being obstructed by the rear strut 120. In some embodiments, the rear strut may connect to and form the rear surface of a grip at the handle portion 114. "Struts" may be defined generally as continuous members which carry primarily normal forces on the compression and tensile edges of the bending section of the riser 102.

The front and rear struts 118, 120 may be tubular, meaning they may have internal cavities running along their lengths. Tubular struts may have decreased weight as compared to solid struts. In some embodiments, the struts 118, 120 may be non-tubular or may have discontinuous voids within their lengths, provided their front and rear surfaces are continuous. The riser 102 and struts 118, 120 may beneficially comprise a lightweight metal or composite material to reduce weight while ensuring structural stability.

A neutral axis of the riser 102 may extend in a Z-direction, as shown by neutral axis NA in FIGS. 2A and 3A. In the pictured embodiment, the neutral axis NA runs through two points on the riser that form a line parallel to the Z-axis. These points may be two points of attachment 124, 126 of the limbs 106, 110 to the riser 102. See FIG. 1A. A central plane may be defined as being vertical and dividing the left and right sides of the bow 100 with the neutral axis lying in-plane. For convenience in referring to the figures, a left side 128 and a right side 130 of the bow are indicated in FIGS. 2A and 3A. Due in part to the asymmetric shape of the sight window portion 116, the central plane may not necessarily divide the mass of the bow 100 into equal left and right sides.

In some arrangements, the central plane is parallel to the left and right sides 128, 130 of the bow, such as by extending in a Y-Z plane established by the axes Y and Z in FIG. 1A. The central plane may be an arrow flight plane of the bow 100 (i.e., the plane through which an arrow is shot from the bow). In some embodiments, the central plane extends through the grip of the handle portion 114, but in other cases the handle portion 114 may be offset from the central plane. Thus, portions of the bow 100 may be offset from the central plane while other portions extend through the central plane.

The neutral axis NA and/or central plane may be used for reference in identifying transition portions of the front and rear struts 118, 120. FIG. 3B shows, for example, that the front strut 118 may transition from extending along the neutral axis NA to be offset laterally from the neutral axis NA when moving down the upper end 104 of the riser 102. A front transition portion 132 may be defined by the portion of the front strut 118 that curves between the neutral axis NA and the offset portion of the front strut 118. The front transition portion 132 may have a height $H_1$. FIG. 1B also shows $H_1$.

FIG. 2B shows that the rear strut 120 may also transition from extending along the neutral axis NA to being offset laterally from the neutral axis NA as well. A rear transition portion 134 may have a height $H_2$, which is also shown in FIG. 2B. The heights $H_1$ and $H_2$ of each of the front and rear transition portions 132, 134 may differ in length. A height $H_3$ may be defined as the total height of transition for both the front and rear transition portions 132, 134. Thus, the total height of transition may be greater than either the height $H_1$ of the front transition portion 132 or the height $H_2$ of the rear transition portion 134. The riser 102 may also have heights $H_1$ and $H_2$ described as having different vertical positions along the neutral axis NA. In the example embodiment, $H_1$ is higher along the vertical axis (i.e., Z-axis) than $H_2$. The front transition portion 132 also has a greater length of transition ($H_1$) than the length of transition ($H_2$) of the rear transition portion 134. In some embodiments, the total length of transition ($H_3$) may be at least four inches. The span of at least four inches has provided improved stiffness over shorter heights in testing, but shorter heights of $H_3$ may also be implemented. A midpoint of height $H_1$ may be about one-half inch to about four inches higher along the neutral axis than a midpoint of height $H_2$. It may be advantageous to relatively raise the front strut window transition portion instead of the rear strut transition portion since a raised front portion may provide more visibility through the sight window portion of the riser than a rear strut transition portion.

The support structures 122 may be lofted between the front and rear struts 118, 120, meaning they may be curved to follow a lofted surface between the curves defined by the front and rear struts 118, 120. See, e.g., FIGS. 2B, 3B, and 4. In some arrangements, the support structures 122 may be straight and directly connect the front and rear struts 118, 120. The support structures 122 may extend away from the front and rear struts 118, 120 at different angles based on the anticipated loading of the riser 102 and the overall bending characteristics of the sight window portion 116. Generally, the support structures 122 may be positioned in the riser 102 in a manner optimizing stiffness without unnecessarily increasing weight and material costs to the riser 102. Support structures 122 may beneficially be non-tubular to increase their stiffness and to reduce their thickness, thereby reducing the lateral profile of the riser 102 (as shown in FIG. 1A).

Figure 4:
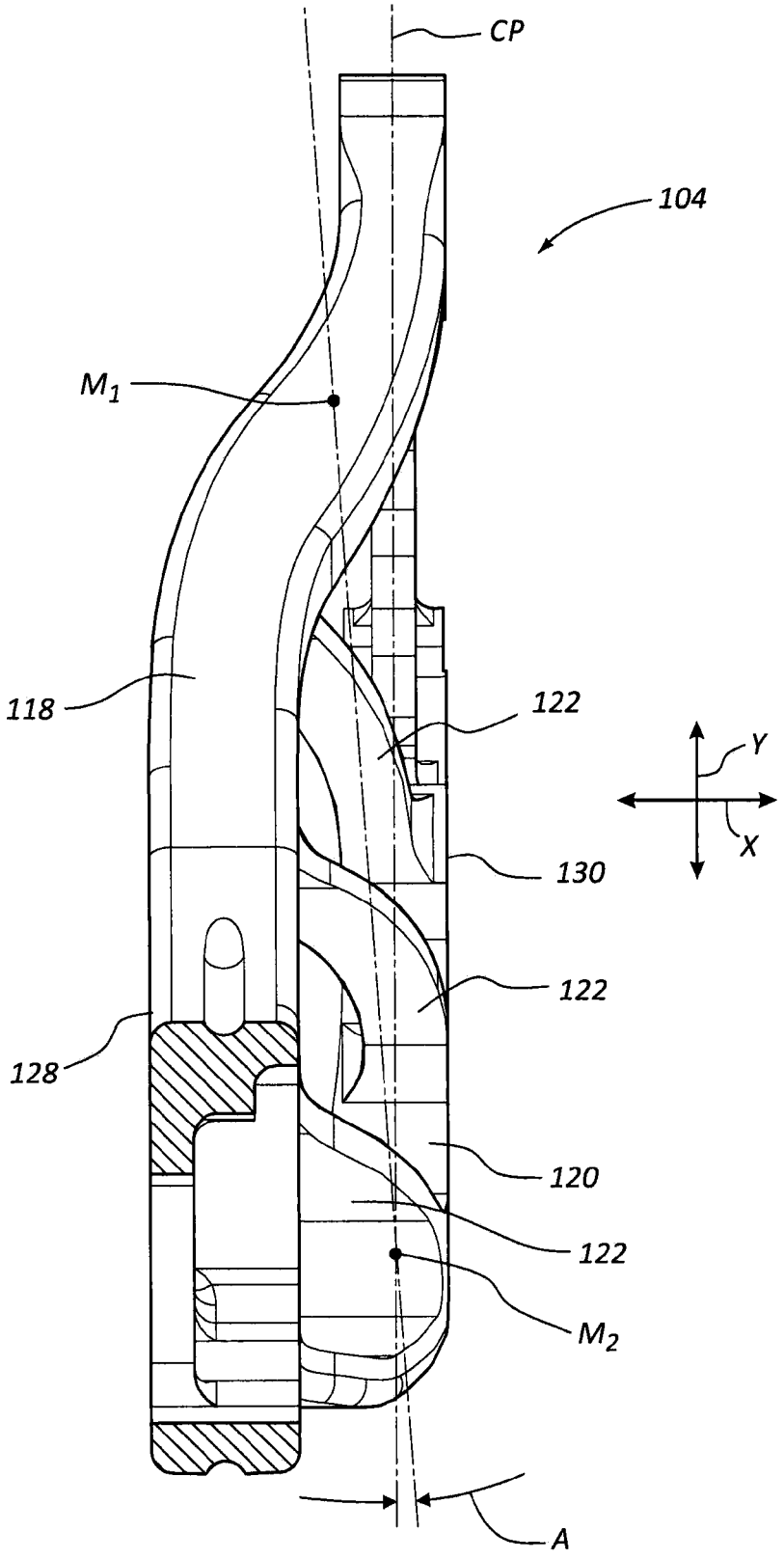
FIG. 4 is a section view of the upper end of the riser of the bow of FIG. 1A taken through section lines 4-4 in FIG. 1A.

FIG. 4 is a view of the upper end 104 of the riser 102 taken through section lines 4-4 in FIG. 1A. The front strut 118 and rear strut 120 extend upward (e.g., in the Z-direction) from this view. The center plane CP is shown parallel to the Y-Z plane. The section lines 4-4 are taken through the bottom of the rear transition portion 134 to show the entire front and rear transition portions 132, 134 from below. A midpoint $M_1$ of the front transition portion 132 and a midpoint $M_2$ of the rear transition portion 134 are shown. These midpoints $M_1$, $M_2$ are midpoints of the heights $H_1$, $H_2$ of FIGS. 1A-3B within their respective front and rear struts 118, 120. See also FIG. 1B. A plane that extends in the Z-direction passing through $M_1$ and a centroid of the rear strut (at the vertical position of $M_1$) or a plane passing through $M_2$ and a centroid of the front strut (at the vertical position of $M_2$) may form an angle with respect to the center plane CP at a common vertical location. In some embodiments, a line between the midpoint $M_1$ of the front transition portion 132 and the midpoint $M_2$ of the rear transition portion 134 may not be parallel to the central plane CP, as shown by angle A in FIG. 4. In one embodiment, the lateral difference between $M_1$ and $M_2$ may be at least about 0.066 inches. In some arrangements, if the transition shape of the front and rear struts is identical, the lateral positions of the midpoints $M_1$, $M_2$ may be parallel with the central plane CP as compared to each other (i.e., rather than compared to a centroid at the vertical position of the midpoints).

Figure 5C:
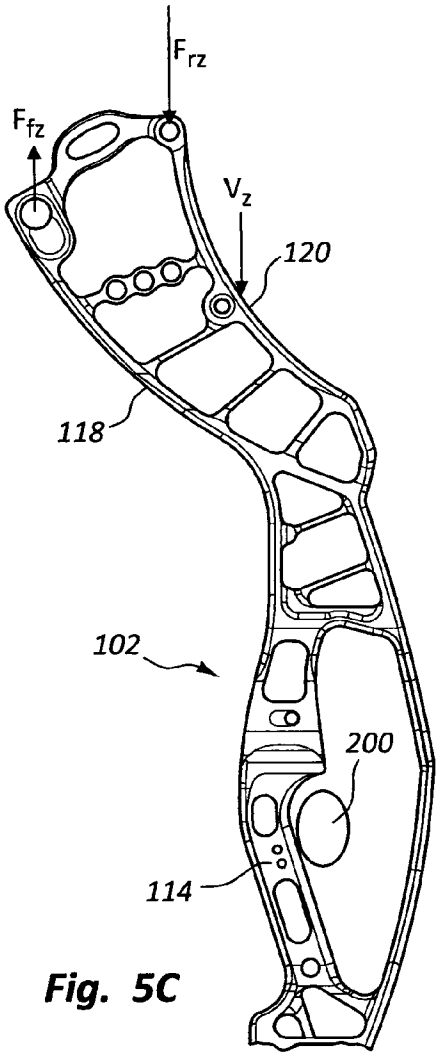
FIGS. 5A-5C illustrate forces applied to the upper end of the riser of the bow of FIG. 1A under an example loading.
Figure 5B:
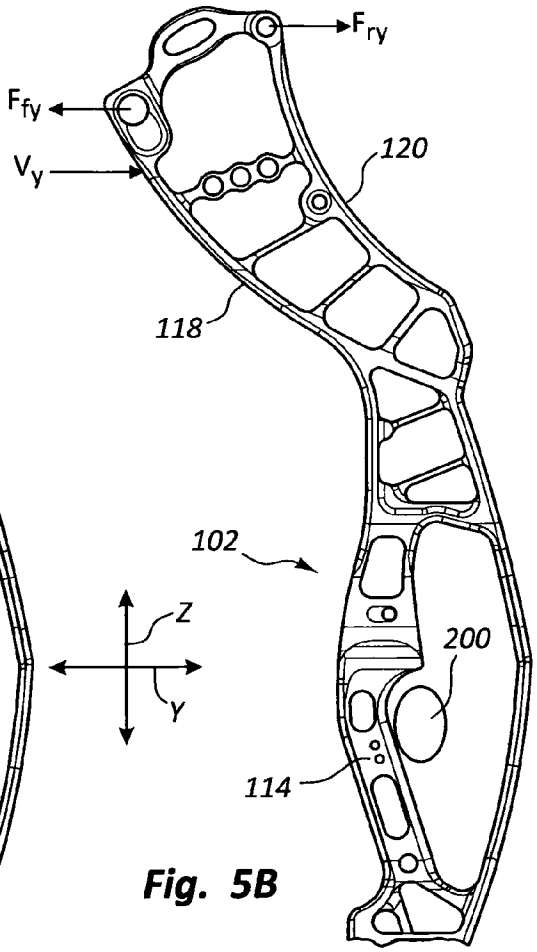
Figure 5A:
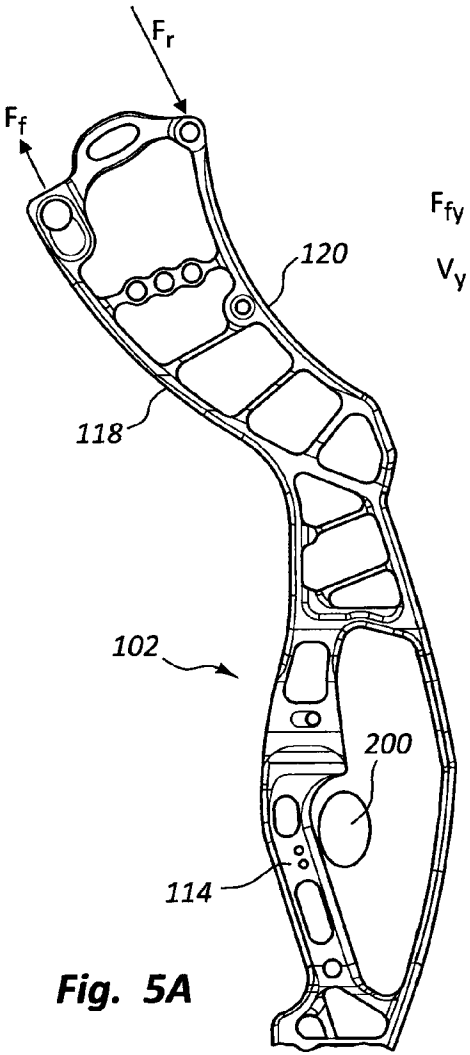

FIGS. 5A-5C illustrate forces applied to the upper end 104 of the riser 102 by a limb when a fixed support 200 supports the grip of the handle portion 114. Limbs are typically installed on the riser 102 using a limb bolt positioned near the upper end of the front strut 118 and a pivot point (or pivot dowel) positioned near the upper end of the rear strut 120. When the bow 100 is placed under load (e.g., by the archer drawing the bowstring 112), a force $F_f$ may be applied at the front strut 118 and a force $F_r$ may be applied at the rear strut 120. Under normal loading conditions (e.g., drawing the bowstring), the limb may produce force $F_f$ pulling on the front strut 118 and force $F_r$ into the rear strut 120. Corresponding forces may be applied at the lower end 108 of the riser 102. These forces $F_f$, $F_r$ may produce an equivalent rearward- and inward-directed force to the riser 102 that causes a twisting moment. Alternatively, the loading of the bow 100 may be described as being forward-backward, since the handle portion 114 may support the archer's hand horizontally (as signified by the fixed support 200) and the archer may load the bowstring 112 by pulling horizontally as well. The resultant normal forces $F_f$, $F_r$ on the riser 102 may thus be the product of these forward-backward loads being transmitted through the bowstring and limbs to the riser.

The forces $F_f$, $F_r$ may be applied to the riser 102 about perpendicular to a limb, as seen in FIG. 5A, so these forces may be divided into horizontal components $F_{fy}$, $F_{ry}$ (shown in FIG. 5B) and vertical components $F_{fz}$, $F_{rz}$ (shown in FIG. 5C). The net horizontal shear may be $V_y$ in FIG. 5B and the net vertical shear may be $V_z$ in FIG. 5C.

Figure 6A:
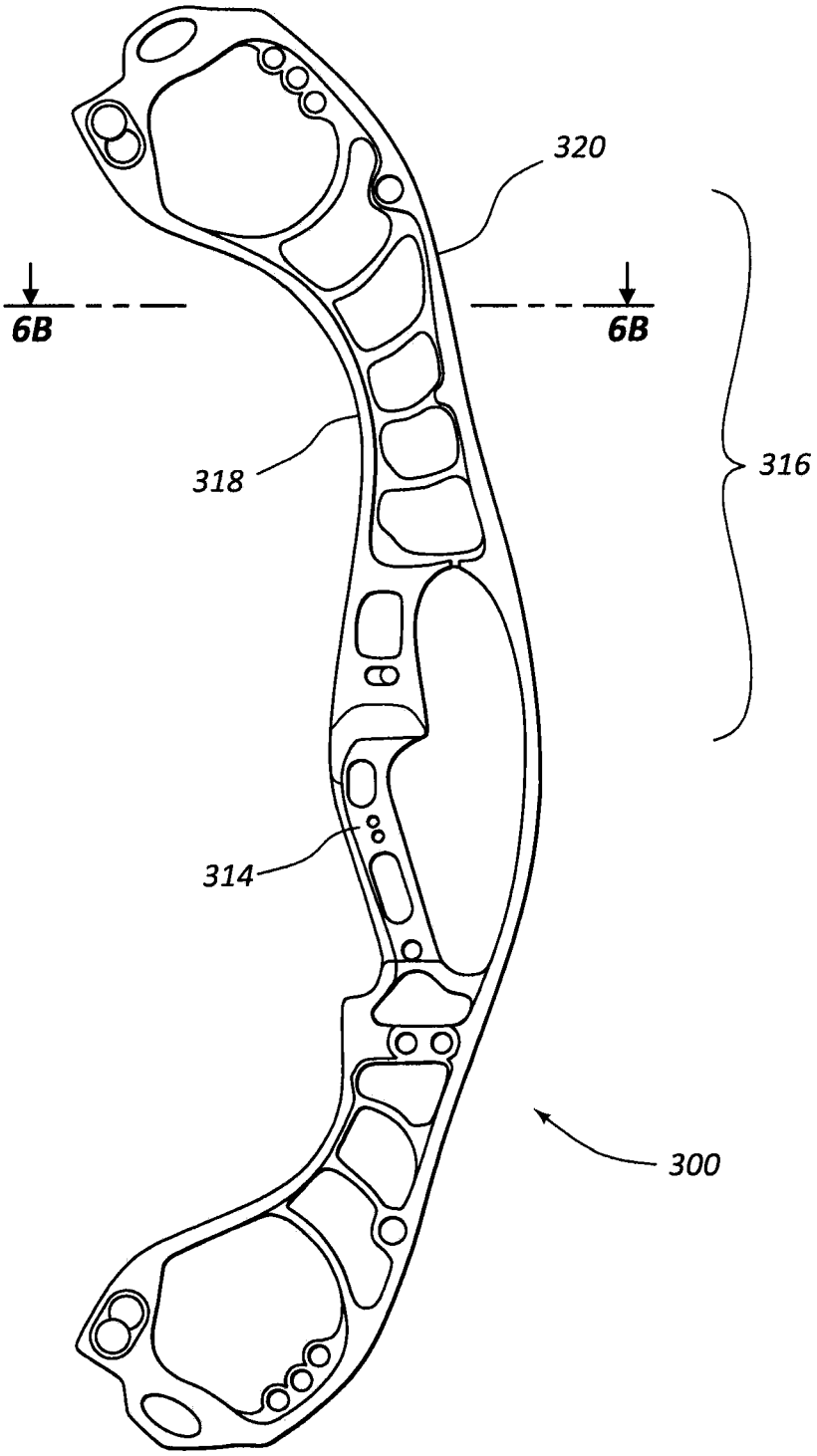
Fig. 6A (Prior Art)
FIG. 6A is a side view of a conventional riser.
Figure 6B:
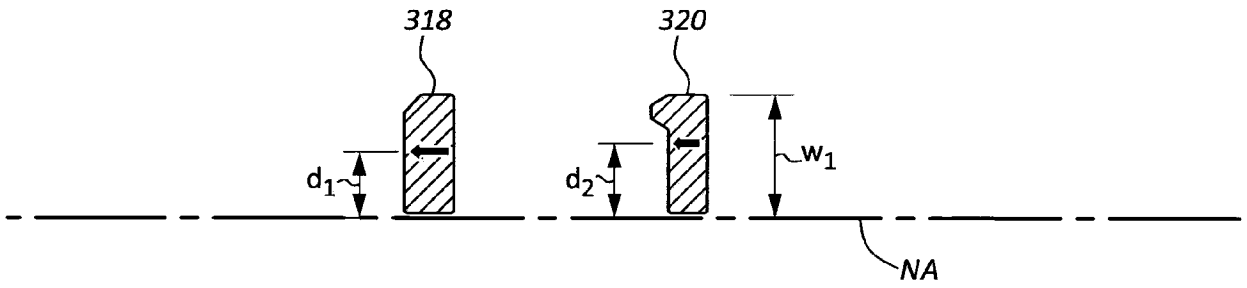
Fig. 6B (Prior Art)
FIG. 6B is a shear flow diagram of a section of the riser of FIG. 6A taken through section lines 6B-6B in FIG. 6A.
Figure 7:
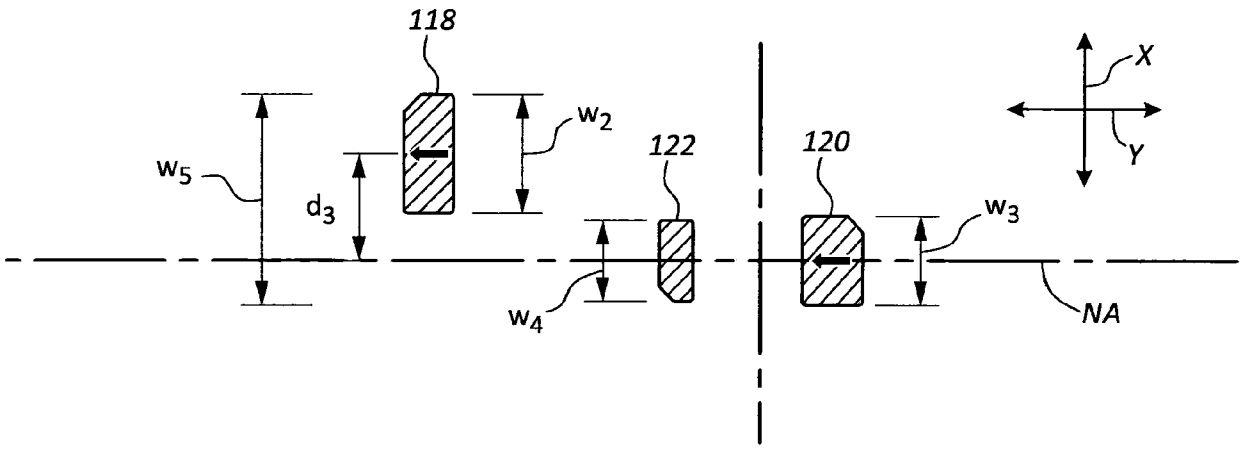
FIG. 7 is a shear flow diagram of a section of the riser of FIG. 1A taken through section lines 7-7 in FIG. 1A.

The net forces $V_y$, $V_z$ may be referred to as net shear forces applied to the riser 102. The net shear forces may produce a shear flow through the upper end 104 of the riser, thereby contributing to the tendency of the upper end 104 to bend under load. FIGS. 6A-7 provide a comparative example of the effect of the offset sight window transitions on this shear flow and how the offset structure may increase stiffness and reduce vibration.

FIG. 6A shows a conventional riser 300 having a sight window portion 316 above a handle portion 314. In this conventional riser 300, front and rear struts 318, 320 are generally parallel at least where they transition to the upper limb attachment point. FIG. 6B shows a section view of the front and rear struts 318, 320 taken through section lines 6B-6B in FIG. 6A. As shown in FIG. 6B, both the front strut 318 and the rear strut 320 are offset from the neutral axis by distances $d_1$ and $d_2$, respectively. Distances $d_1$ and $d_2$ are both simultaneously greater than zero throughout the sight window transitions of the front and rear struts 318, 320 of this conventional riser 300. Because both the front and rear struts 318, 320 are both offset from the neutral axis, shear flow through the window transition portion of the riser 300 tends to simultaneously bend both of the struts 318, 320 toward the neutral axis/central plane along which the limb's forces are applied. A torque moment resulting from shear flow through the section receives contribution from both the front and rear struts 318, 320, so there is more likely to be twisting at the window transition in this riser 300.

FIG. 7 shows a section view through the sight window transition of the front and rear struts 118, 120 taken through section line 7-7 in FIG. 1A. In this diagram, only one of the shear flow components of the riser 102 is offset from the neutral axis NA, and the other shear flow components lie on the neutral axis NA. Namely, the front strut 118 section is offset from the neutral axis NA by distance $d_3$ and the sections of the support structures 122 and the rear strut 120 lie on the neutral axis NA. For this reason, when the riser 102 is loaded by the limb, there is less tendency for the riser 102 to bend toward the neutral axis NA because there are fewer shear flow components and resulting shear force offset from the neutral axis NA, so, therefore, there is less torque on the riser 102 at that location.

The present embodiments also may be defined as having a front strut having a first area centroid and a rear strut having a second area centroid, wherein the first area centroid has a different lateral position than the second area centroid. As shown in FIG. 7, the front strut 118 may have an area centroid that is laterally offset from an area centroid of the rear strut 120 (i.e., relative to the X-direction). This may mean that the area centroids are not parallel to the neutral axis of the riser 102, or that a line through the area centroids is not parallel to the neutral axis. One of the area centroids of the front and rear struts 118, 120 may lie on the neutral axis of the riser 102 (e.g., the area centroid of the rear strut 120 in FIG. 7). An area centroid may be defined as the center of area of a section through the riser 102. The first and second area centroids discussed in this embodiment are taken from a section at the same vertical location anywhere within the sight window transition portion of the bow (e.g., where transition portions 132, 134 overlap or, alternatively, within height $H_3$ where an area centroid of a section of at least one of the front and rear struts 118, 120 is offset from the neutral axis NA).

Area centroids of the sections of the front and rear struts 118, 120 may be offset in some cases due to minor non-symmetry in their shapes (e.g., differences in blind recesses or corner rounding). However, these minor differences should not be construed as being sufficiently offset unless an axis extending through the area centroids to the plane of the neutral axis forms an included angle of at least 10 degrees with the neutral axis.

The offset front and rear transition portions 132, 134 minimize the amount of shear flow components and resulting shear force offset from the neutral axis at any given point along their overall lengths (e.g., along $H_3$). This may lead to greater stiffness since the number and size of the offset shear flow components is minimized. Because the offset riser structure of FIGS. 1A-5C has vertically offset front and rear transition portions 132, 134, there is a minimal amount of distance along the riser 102 in the transition area of the bow that has both front and rear struts 118, 120 offset from the neutral axis. Thus, the shear flow travels more directly through the neutral axis NA than in a conventional, parallel, non-offset-transitioning bow. This creates lower twisting and bending moments resulting in lower deflections and stresses of the riser structure.

Additionally, the shear flow components in FIG. 6B have a combined width $w_1$. The shear flow components in FIG. 7 have respective widths $w_2$, $w_3$, and $w_4$, and an overall width of $w_5$. The overall width $w_5$ is greater than the widths $w_2$, $w_3$, and $w_4$ of each of the shear flow components of the riser 102, but the overall width $W_1$ is the same as the widths of each of the shear flow components of the conventional riser 300. This further indicates a difference between an offset transition portion and a non-offset transition portion, since an overall width of an offset transition portion may be significantly greater than a width of the component parts of the overall width.

In another aspect of the present disclosure, a method of reducing twist and deflection of a bow riser may be provided, comprising providing a bow riser having a front strut and a rear strut, the front strut having a front sight window transition portion and the rear strut having a rear sight window transition portion, wherein the front and rear sight window transition portions are vertically staggered along a longitudinal axis of the bow riser. For example, the vertical stagger may be relative to the Z-axis in FIG. 1A. The method may further comprise loading the bow riser to induce a front shear flow component and a rear shear flow component, wherein one of the front or rear shear flow components lies near or along a neutral axis of the bow riser while another of the front or rear shear flow components lies off the neutral axis. The shear flow components of FIG. 7 have these characteristics since the shear flow component of the rear strut 120 is on the neutral axis NA and the front strut 118 component is offset from the neutral axis NA by distance $d_3$.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An offset riser for an archery bow, the riser comprising:
- an upper end and a lower end, the upper end having an upper limb attachment point, the lower end having a lower limb attachment point, wherein a central plane laterally divides the bow through the upper and lower limb attachment points;
- a handle portion positioned between the upper end and the lower end;
- a front strut positioned front-most on the riser from the upper end to the handle portion, the front strut having a front sight window portion, the front sight window portion being offset from the central plane;
- a rear strut positioned rear-most on the riser from the upper end to the handle portion, the rear strut having a rear sight window portion, the rear sight window portion being offset from the central plane;
- wherein the front sight window portion has a different vertical location of transition than the rear sight window portion.

2. The offset riser of claim 1, wherein the front sight window portion has a greater vertical length of transition than the rear sight window portion.

3. The offset riser of claim 1, wherein the front and rear struts are tubular.

4. The offset riser of claim 1, wherein the front and rear struts are connected by a web.

5. The offset riser of claim 4, wherein the web is non-tubular.

6. The offset riser of claim 1, wherein a distance between a top of a transition portion of the front sight window portion and a bottom of a transition portion of the rear sight window portion is at least four inches.

7. The offset riser of claim 1, wherein a vertical distance between a center of a transition portion of the front sight window portion and a center of a transition portion of the rear sight window portion is at least one half inch.

8. The offset riser of claim 1, wherein a line between a midpoint of a transition portion of the front sight window portion and a midpoint of a transition portion of the rear sight window portion is not parallel to the central plane.

9. The offset riser of claim 1, wherein at transition portions of the front and rear sight window portions, a combined lateral width of the transition portion of the front and rear sight window portions is greater than a lateral width of either the transition portion of the front sight window portion or the transition portion of the rear sight window portion.

10. An archery bow having an offset riser, the bow comprising:

a riser having a lower end, an upper end, a sight window portion laterally offset from the upper and lower ends, and a window transition portion positioned between the sight window portion and the upper end, the window transition portion having a front strut and a rear strut, the front strut having a first area centroid, the rear strut having a second area centroid, the front strut being positioned front-most on the riser from the upper end of the riser to a handle portion of the riser, the rear strut being positioned rear-most on the riser from the upper end of the riser to the handle portion;

an upper limb attached to the upper end;

a lower limb attached to the lower end;

a bowstring attached to the upper and lower limbs;

wherein the first area centroid has a different lateral position than the second area centroid.

11. The archery bow of claim 10, wherein at least one of the first and second area centroids lies on a neutral axis of the riser.

12. The archery bow of claim 10, wherein the first and second area centroids are positioned non-parallel to a neutral axis of the riser.

13. The archery bow of claim 10, wherein the window transition portion comprises a rib envelope.

14. The archery bow of claim 10, wherein the window transition portion has a height of at least four inches.

15. The archery bow of claim 10, wherein a front portion of the window transition portion transitions to the upper end higher on the riser than a rear portion of the window transition portion.

16. The archery bow of claim 10, wherein the front and rear struts are each laterally narrower than an overall lateral width of the window transition portion.

* * * * *